US010156804B2

(12) United States Patent
Portnoy et al.

(10) Patent No.: US 10,156,804 B2
(45) Date of Patent: Dec. 18, 2018

(54) COLOR SEPARATIONS ON PHOTO DRUMS

(71) Applicant: HP INDIGO B.V., Amstelveen (NL)

(72) Inventors: Vitaly Portnoy, Ness Ziona (IL); Maya Bar-Sadeh, Ness Ziona (IL); Michel Assenheimer, Kfar Sava (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/545,919

(22) PCT Filed: Mar. 12, 2015

(86) PCT No.: PCT/EP2015/055189
§ 371 (c)(1),
(2) Date: Jul. 24, 2017

(87) PCT Pub. No.: WO2016/141990
PCT Pub. Date: Sep. 15, 2016

(65) Prior Publication Data

US 2018/0017885 A1 Jan. 18, 2018

(51) Int. Cl.

| | |
|---|---|
| ***G03G 15/01*** | (2006.01) |
| ***G03G 15/10*** | (2006.01) |
| ***G03G 15/00*** | (2006.01) |
| *B41J 2/21* | (2006.01) |

(52) U.S. Cl.
CPC ..... *G03G 15/0173* (2013.01); *G03G 15/0131* (2013.01); *G03G 15/105* (2013.01); *G03G 15/50* (2013.01); *B41J 2/2132* (2013.01); *G03G 15/10* (2013.01); *G03G 2215/0177* (2013.01); *G03G 2215/1623* (2013.01)

(58) Field of Classification Search
CPC . B41J 2/21; B41J 2/2132; B41J 2/2103; B41J 2/2146; G03G 15/0173; G03G 15/0131; G03G 15/105; G03G 2215/0177; G03G 2215/1623
See application file for complete search history.

(56) References Cited

U.S. PATENT DOCUMENTS

| | | | | |
|---|---|---|---|---|
| 4,980,760 | A | 12/1990 | Hiratsuka et al. | |
| 6,263,174 | B1 | 7/2001 | Fuchiwaki et al. | |
| 6,476,839 | B1 | 11/2002 | Nakajima et al. | |
| 6,747,683 | B2 | 6/2004 | Nakajima et al. | |
| 2013/0147888 | A1 | 6/2013 | Gordon et al. | |
| 2016/0165070 | A1* | 6/2016 | Tanabe | G06K 15/408 358/1.14 |

FOREIGN PATENT DOCUMENTS

| | | | |
|---|---|---|---|
| JP | 58216281 | A | 12/1983 |
| JP | 08292683 | A | 11/1996 |

OTHER PUBLICATIONS

Preview Color Separations, <http://helpx.adobe.com/illustrator/using/printing-color-separations.html> Retrieved on Jul. 11, 2017, 9 pages.
Quality Issues in Print, <http://www.prepressure.com/design/troubleshooting/quality-issues-in-print> Retrieved on Jul. 11, 2017, 4 pages.

* cited by examiner

*Primary Examiner* — Thinh H Nguyen
(74) *Attorney, Agent, or Firm* — HP Inc. Patent Department

(57) ABSTRACT

A photo drum may be to receive a color separation. A controller may be to change a location of the color separation on the photo drum from a first location to a second location when a separation location history for the color separation is outside of a threshold range.

20 Claims, 3 Drawing Sheets

COLOR SEPARATIONS ON PHOTO DRUMS

CROSS-REFERENCE TO RELATED APPLICATION

This application is a U.S. National Stage Application of and claims priority to International Patent Application No. PCT/EP2015/055189, filed on Mar. 12, 2015, and entitled "COLOR SEPARATIONS ON PHOTO DRUMS."

BACKGROUND

Some printers may create an image on a photo plate or photo drum and then may copy the image onto media. Some printers may transfer the image from the photo drum or photo plate onto a transfer member (e.g. drum or belt). The transfer member may then transfer the image onto the media.

BRIEF DESCRIPTION

Figure 1A:
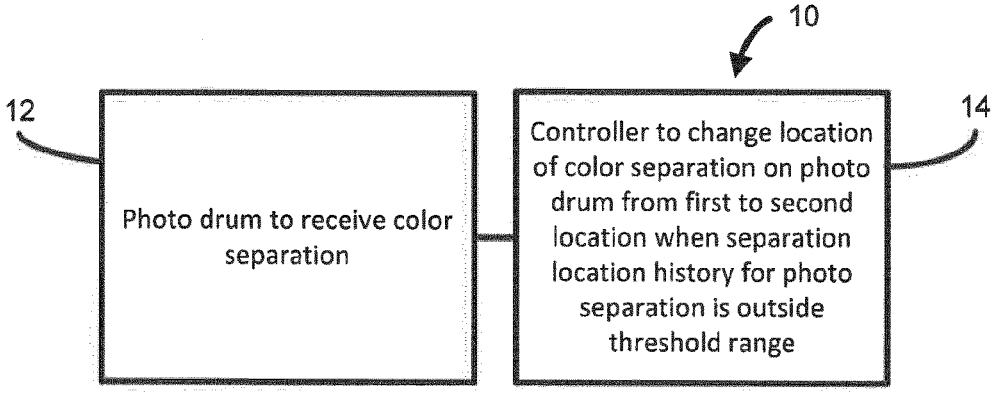
Figure 1B:
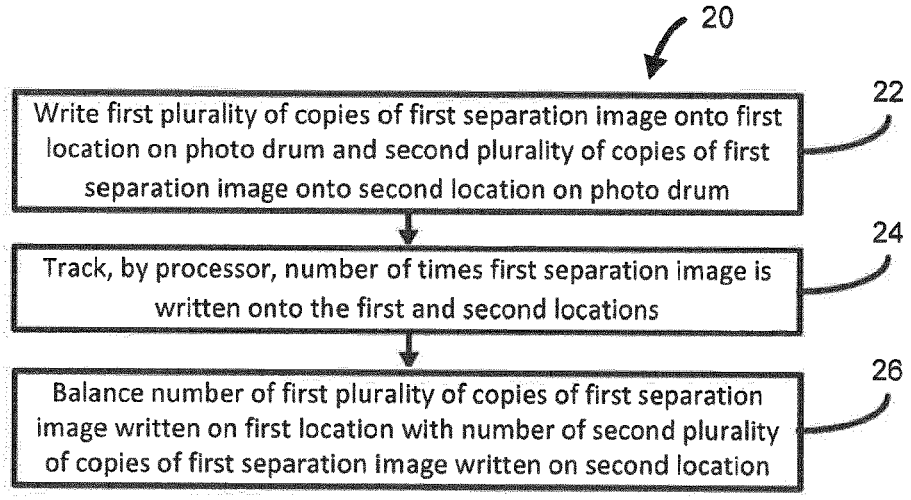
Figure 1C:
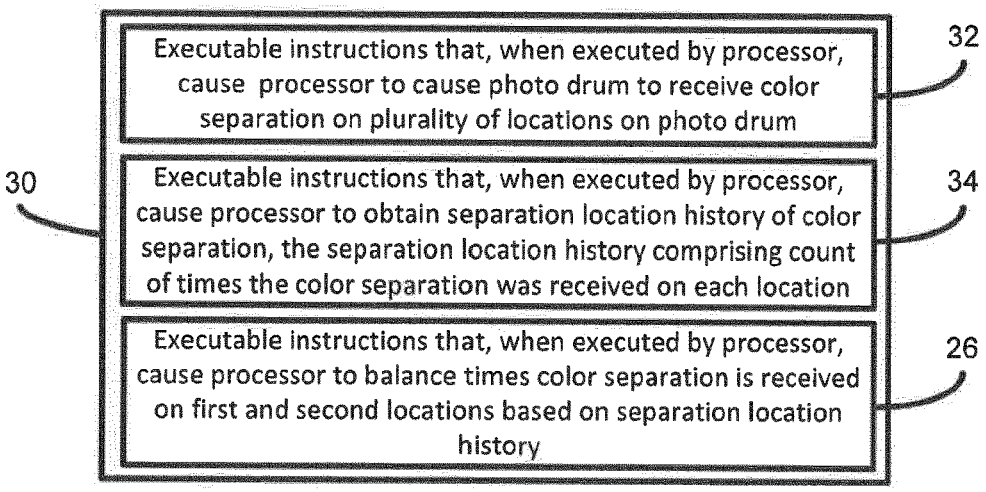
Figure 2A:
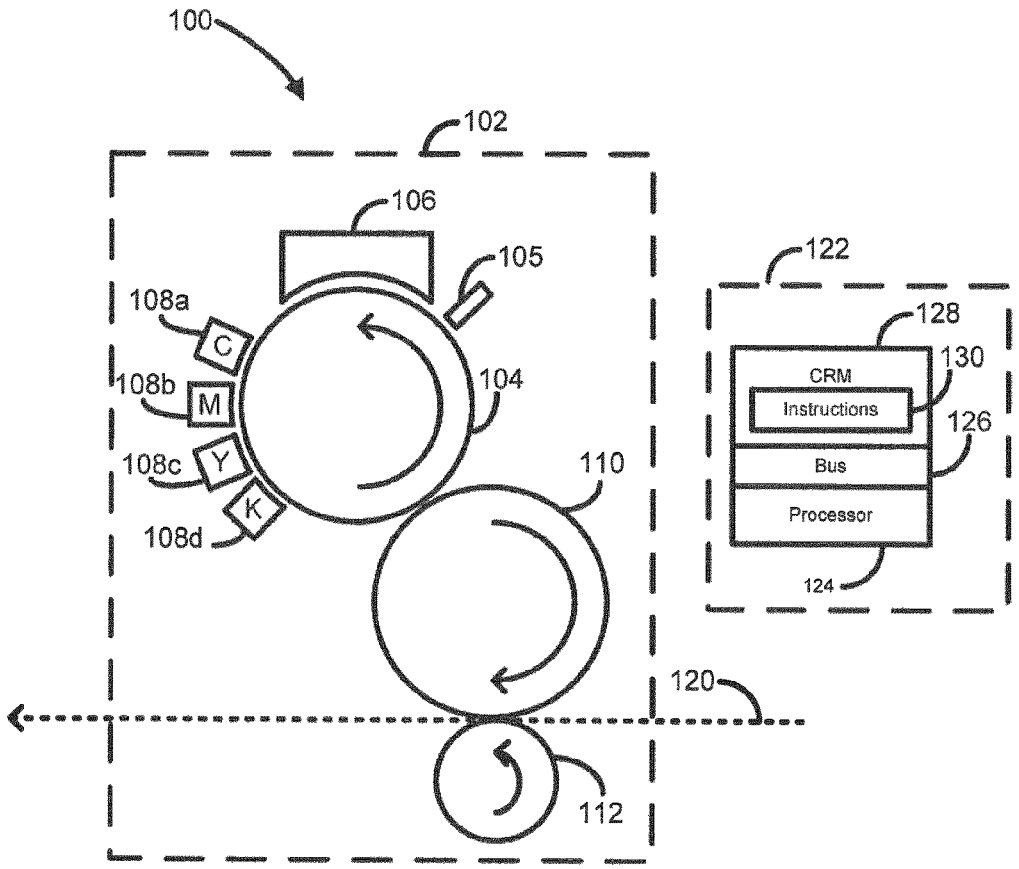
Figure 2B:
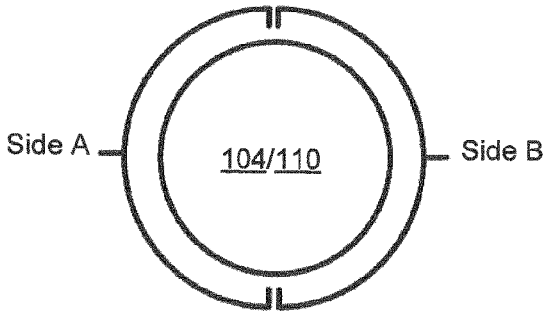
Figure 2C:
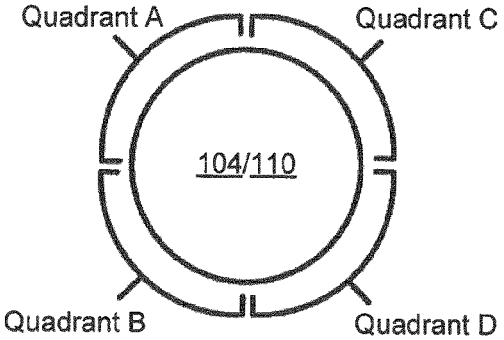
Figure 3:
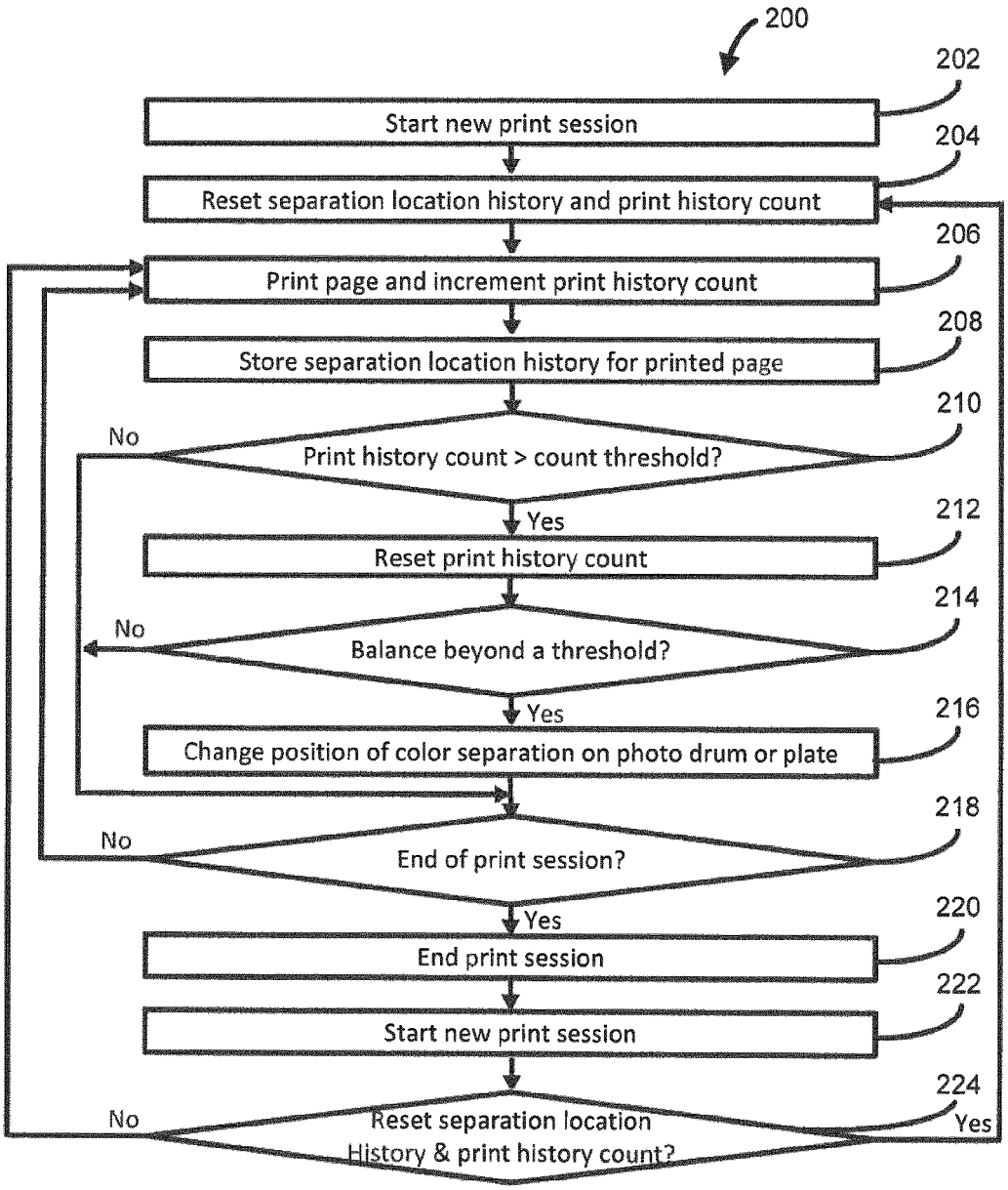

Some examples are described with respect to the following figures:

FIG. 1*a* illustrates a printing system according to some examples;

FIG. 1*b* is a flow diagram illustrating a method of printing according to some examples;

FIG. 1*c* is a block diagram illustrating a non-transitory computer readable storage medium according to some examples;

FIG. 2*a* is a simplified illustration of a printing system according to some examples;

FIG. 2*b-c* are each a simplified illustration of a photo drum according to some examples; and FIG. 3 is a flow diagram illustrating a method of printing according to some examples.

DETAILED DESCRIPTION

The following terminology is understood to mean the following when recited by the specification or the claims. The singular forms "a," "an," and "the" mean "one or more." The terms "including" and "having" are intended to have the same inclusive meaning as the term "comprising".

Printers that create an image on a photo drum or photo plate may exhibit ghosting. In this application, the phrase "photo drum" will be defined to include photo imaging drums (PIDs) having photoreceptor coatings, and photoconductors e.g. a photo imaging plates (PIPs), for example. A photo drum is the device inside the printer that receives an image from a writing device, for example a laser.

Ghosting is when an image from a previously printed page appears on the currently printed page. The ghost image may appear as variations in optical density, gloss level, or dot gain. Ghosting may appear when switching between a page/image that was printed a number of times in a row, to printing a different page/image. The ghost image may be strongest on the first copy of the new page/image, and may or may not fade as the new page/image is printed multiple times.

When printing multiple copies of the same page in a row, the same image is created on the photo drum multiple times, one time for each page printed. When the image is a color image, color separations (separation images) are created on the photo drum. In some printers, a 4 color process is used, e.g. cyan, yellow, magenta and black (CYMK). For a 4 color process, 4 color separations are created on the photo drum, one for each color (e.g. CYMK). The separations may be printed sequentially in the same order on the photo drum for each page, for example: yellow, magenta, cyan and then black (YMCK).

In some examples, the photo drum may be large enough that two separations will fit on the drum at the same time. When the printing order is (YMCK), the yellow and cyan color images may be located on side A and the magenta and black images will be located on side B. For example, in a first full drum revolution (360 degrees), a first color separation (e.g. Y) may be created on a first location (e.g. side A) of the photo drum, and a second color separation (e.g. M) may subsequently be created on a second location (e.g. side B) of the photo drum. In some examples, after these separations are transferred from the photo drum to a member or substrate, the respective locations on the photo drum may then be cleaned such that the latent images (e.g. electrostatic images) are erased (cleaning may involve e.g. discharging residual charge and removing ink not transferred from the photo drum), although in other examples multiple separations may accumulate on the photo drum (or an intermediate transfer member) before being transferred to the media. Then, in a second drum revolution, a third color separation (e.g. C) may subsequently be created on the first location (e.g. side A), and a fourth color separation (e.g. K) may subsequently be created on the second location (e.g. side B), after which the third and fourth separations may be transferred to the separate member or substrate. However, in some examples, as mentioned earlier, multiple separations may accumulate on the photo drum (or an intermediate transfer member) before being transferred to the media. This completes one "color separation cycle", which is a sequential creation on a photo drum of each color separation used in the print session (e.g. 4 color separations for a 4 color process). After the photo drum is cleaned and the latent images are erased, additional color separation cycles may begin. In some examples, the color separations may be created on the same locations as in the previous color separation cycle, for example because an integer number of drum revolutions were used to create the color separations. In other examples, if a non-integer number of drum revolutions are used to complete each color separation cycle, then in each subsequent cycle color separations may be created in different locations than in a previous color separation cycle. Each of these examples are encompassed by the present disclosure.

When a printer uses a transfer member to move the images from the photo drum onto media, the images on the transfer belt may be in the same order/location as the images on the photo drum. The transfer belt may also be known as a blanket. When printing black and white images a black separation is used. In some examples, the black separation may be printed on one side but not the other side of the photo drum.

When a printer is printing multiple copies of the same page, one of the printer's sub-systems may have a delay which results in that sub-system not being ready to print at a particular time during the print session. When this occurs, null segments may be inserted into the printer's image pipeline, depending on the length of the delay. A "null segment" occurs where a location of the photo drum is skipped once during revolution of the photo drum such that the location does not receive a color separation. But in subsequent revolutions the skipped location may, in some examples, begin to receive color separations again. If at least two color separations are created per drum revolution, then a single null segment may delay the current print session by half of a drum revolution (180 degrees) such that a side of the photo drum may not receive a photo separation during a particular drum revolution. An odd number of null segments may cause the printer to delay the current print session by an uneven number of half drum revolutions. If color separations are created in two sides of the photo drum, then when the printer is delayed by an odd number of half drum revolutions, the color separations may switch sides on the photo drum. When the color separations switch sides on the photo drum, the two colors that were located on side A may switch to side B and the two colors that were located on side B may switch to side A.

The delays in the printer's sub-systems may come at random times, therefore null segments may also come at random times. Each time an odd number of null segments are inserted into the image pipeline, the color separations may switch sides on the photo drum and on the intermediate transfer member or transfer belt. Some printers may not specifically control which side of the photo drum the color separations are located on. In ideal cases, in e.g. a 4 color process, the same color separation may be printed on the same location (e.g. side) of the photo drum 100% of the time. But due to the random injection of null segments, the color separations may occasionally switch sides on the photo drum. This may result in each color separation being printed on the same side of the photo drum more than 80% of the time, for example. As a result, during a long printing run the same image may be printed on the same side of the photo drum for many pages in a row. When the separations do switch sides, or a new image is printed, ghosting may appear.

Accordingly, the present disclosure provides that the printer may balance the number of times that a color separation may be created/printed on a particular location (e.g. side or quadrant) of the photo drum. The printer may, for example, balance the number of times each separation is printed on a side of the photo drum by counting how many times each color separation was located on each side of the photo drum. When a color separation has been located on one side of the photo drum more than some threshold percentage of times, an odd number of null segments may be inserted into the image pipeline to cause the color separations to change locations (e.g. switch sides) on the photo drum. The printer may check the balance every N number of pages printed or N number of color separations created on the photo drum. In some examples, N may be an integer between 1 and 1,500 pages (e.g. 100 pages), or between 4 and 6,000 color separations (e.g. 400 color separations). In some examples, this may result in reduced ghosting.

FIG. 1*a* is a block diagram illustrating a printing system 10 according to some examples. The printing system 10 may include a photo drum 12 to receive a color separation. The printing system 12 may include a controller 14 to change a location of the color separation on the photo drum from a first location to a second location when a separation location history for the color separation is outside of a threshold range. A "separation location history" represents, e.g., the number of times a color separation has been created on a first location of a photo drum and the number of times a color separation has been created on a second location of the photo drum, and likewise for any additional locations on the photo drum in some examples in which there are more than two locations. This may be represented in any suitable way, e.g. as a ratio of the number of times the color separation has been created on the locations, or as a plurality of counts of the number of times the color separations have been created on each of the locations.

FIG. 1*b* is a flow diagram illustrating a method 20 of printing according to some examples. At 22, a first plurality of copies of a first separation image may be written onto a first location on a photo drum and a second plurality of copies of the first separation image may be written onto a second location on the photo drum. At 24, a number of times the first separation image is written onto the first and second locations may be tracked by a processor. At 26, the number of the first plurality of copies of the first separation image written on the first location may be balanced with the number of the second plurality of copies of the first separation image written on the second location.

FIG. 1*c* is a block diagram illustrating a non-transitory computer readable storage medium 30 according to some examples. The non-transitory computer readable storage medium 30 may include executable instructions 32 that, when executed by a processor, cause the processor to cause a photo drum to receive a color separation on a plurality of locations on the photo drum. The non-transitory computer readable storage medium 30 may include executable instructions 34 that, when executed by a processor, cause the processor to obtain a separation location history of the color separation, the separation location history comprising a count of a number of times the color separation was received on each of the plurality of locations. The non-transitory computer readable storage medium 30 may include executable instructions 36 that, when executed by a processor cause the processor to balance the number of times the color separation is received on the first and second locations based on the separation location history.

FIG. 2*a* is a simplified illustration of a printing system 100 according to some examples. The system 100 comprises a printing module 102 for generating images on media. The system 100 may include a system controller 122. Any of the operations and methods disclosed herein may be implemented and controlled in the system 100 and/or controller 122.

The controller 122 may include a processor 124 for executing instructions that may implement the methods described herein. The processor 124 may, for example, be a microprocessor, a microcontroller, a programmable gate array, an application specific integrated circuit (ASIC), a computer processor, or the like. The processor 124 may, for example, include multiple cores on a chip, multiple cores across multiple chips, multiple cores across multiple devices, or combinations thereof. In some examples, the processor 124 may include at least one integrated circuit (IC), other control logic, other electronic circuits, or combinations thereof.

The processor 124 may be in communication with a computer-readable storage medium 128 via a communication bus 126. The computer-readable storage medium 128 may include a single medium or multiple media. For example, the computer readable storage medium 128 may include one or both of a memory of the ASIC, and a separate memory in the controller 122. The computer readable storage medium 128 may be any electronic, magnetic, optical, or other physical storage device. For example, the computer-readable storage medium 128 may be random access memory (RAM), static memory, read-only memory, an electrically erasable programmable read-only memory (EEPROM), a hard drive, an optical drive, a storage drive, a CD, a DVD, and the like. The computer-readable storage medium 128 may be non-transitory. The computer-readable storage medium 128 may store, encode, or carry computer executable instructions 130 that, when executed by the processor 124, may cause the processor 124 to perform any of the methods or operations disclosed herein according to various examples, e.g. balancing the locations of the color separations on photo drums by tracking a separation location history for each color separation.

In some examples, the printing module 102 may be part of a liquid electrophotographic (LEP) printer. The printing module 102 may comprise a photo plate, e.g. a rotatable photo imaging plate (PIP) 104. The PIP 104 may have a photoconductor layer that is electrically charged by a charging unit 105. In some examples, the photo drum may take a different form that than shown in FIG. 2*a*. An imaging unit 106, such as a laser imaging unit, may create a latent image corresponding to a single color separation on the PIP 104 by selectively discharging areas of the photo plate 104 in response to data representing an image to be printed. Printing fluid, e.g. liquid ink, may then be electrostatically transferred from the binary ink developers (BID) 108*a-d* to the charged areas of the PIP 104. Each BID 108*a-d* may transfer a respective ink of a respective color corresponding to a respective color separation. For example, BID 108*a* may transfer cyan (C) ink, BID 108*b* may transfer magenta (M) ink, BID 108*c* may transfer yellow (Y) ink, and BID 108*d* may transfer black (K) ink. In other examples, the printing module 102 may contain different numbers of BIDs corresponding to different numbers of ink separations, such as one (e.g. when using black ink for black and white images), two, three, or five or more.

The PIP 104 may be coupled to a rotatable intermediate transfer member (ITM) 110, for example by gears. The ITM 110 may be covered with a blanket. The PIP 104 and the ITM 110 may, in some examples, have the same diameter and circumference. Ink transferred to the PIP 104 may be electrostatically transferred to the ITM 110. The blanket may be heated which causes oil in the liquid ink to evaporate, leaving a thin resin film on the blanket, with the resin film comprising the image to be printed. The resin film on the blanket may then be transferred to a media in a media path 120 by the application of pressure from a transfer roller 112 (e.g. an impression drum). The PIP 104 and ITM 110 may, for example, each have a diameter that is an integer multiple of the diameter of the transfer roller 112 to allow rotation of the PIP 104, ITM 110, and transfer roller 112 to be synchronized. In some examples, the diameter of the transfer roller may be half of the diameters of the PIP 104 and ITM 110. After printing, the resin film comprises dried, or substantially dried, liquid ink.

In some examples, the PIP 104 and/or ITM 110 may be part of a printing module 102 of a type different than an LEP printer. Other printing modules, including 2D and 3D printing modules, may be used as well that may print other types of printing fluids.

To form a color image, a media may remain attached to the transfer roller 112 and multiple latent images for different color separations of the image to be printed may be formed on the PIP 104 using the respective BIDs 108*a-d*. These color separations may be formed on different locations of the PIP 104, which may then transfer the color separations to corresponding locations of the ITM 110, which may then transfer the color separations to media.

FIG. 2*b-c* are each a simplified illustration of a photo drum, e.g. the PIP 104, according to some examples. In some examples, the locations may comprise two locations such as sides A and B, as shown in FIG. 2*b*. In some examples, the locations may comprise four locations, such as quadrants A, B, C, and D. In other examples, different numbers of locations may be used. In some examples, an even number of locations may be used. Each of the photo drums, e.g. PIP 104, may rotate in a sequence, of e.g. side A to B to A to B and so on, or quadrant A to B to C to D to A to B to C to D and so on.

If e.g. two locations and CMYK color separations are used, then excluding null segments, yellow may be applied to side A in half of a drum revolution, then magenta may be applied to side B in half of a drum revolution, then cyan may be applied to side A in half of a drum revolution, then black may be applied to side B in half of a drum revolution, to complete a color separation cycle in two drum revolutions. The color separation cycle may then be repeated. If e.g. four locations and CMYK color separations are used, then excluding null segments, yellow may be applied to quadrant A in a quarter of a drum revolution (90 degrees), then magenta may be applied to quadrant B in a quarter of a drum revolution, then cyan may be applied to quadrant C in a quarter of a drum revolution, then black may be applied to quadrant D in a quarter of a drum revolution, to complete a color separation cycle in one drum revolution. The color separation cycle may then be repeated. Similar sequences may be performed for different numbers of locations and color separations.

FIG. 3 is a flow diagram illustrating a method 200 of printing according to some examples. In some examples, the orderings shown may be varied, some elements may occur simultaneously, some elements may be added, and some elements may be omitted. In describing FIG. 3, reference will be made to FIG. 2*a*. The method 200 may balance the number of times that a color separation may be printed on a particular side of the photo drum, e.g. the PIP 104.

At 202, a print session may be started using the printing system 100. A "print session" is a session in which a number of pages or images are printed. The print session may include any number of print jobs. In some examples, the print session may include one print job, e.g. a file submitted for printing. In other examples, the print session may include multiple print jobs, e.g. multiple files submitted for printing.

At 204, the separation location history may be reset, and a "print history count" representing a page count (number of pages printed) or separation count (number of separations printed) may be reset by the controller 122. In some examples, the separation location history and/or the print history count may be reset to zero. In other examples, the separation location history and/or the print history count may be reset to nonzero values less than their current values before resetting.

Whether the print history count is reset to zero or nonzero, and the particular value that the print history count is reset to, may e.g. depend on the degree to which the current print session (e.g. print job) is predicted by the controller 122 to exhibit ghosting. For example, the controller 122 may reset the print history count to a higher value if the controller 122 predicts a greater degree of ghosting, and a lower value (e.g. a low positive value, zero, or a negative value) if a low degree of ghosting is predicted. Ghosting levels may depend, for example, on the quality of the media, coating type, image content, and printed ink coverage. The controller 122 may receive data (e.g. based on sensor feedback and/or based on image data) representing e.g. the quality of the media, coating type, image content, and printed ink coverage, and use these to infer and predict ghosting levels.

In general, as will be described, the print history count as well as the increments to the print history count may be dynamically adjusted throughout and in between print sessions based on changing conditions (e.g. changes in ghosting or predicted amount of ghosting) of the print sessions.

At 206, a page may be printed and the print history count may be incremented by the controller 122. The increment to the print history count may be an increase of 1, 2, or any other value. In some examples, if the controller 122 predicts a high degree of ghosting in the current print session, then the controller 122 may increment by a high value (e.g. 2 or more). In some examples, if the controller 122 predicts a low degree of ghosting in the current print session, then the controller 122 may increment by a low value (e.g. 1), or in some examples exhibit a low degree of ghosting, the controller 122 may not increment the print history count at all.

At 208, the separation location history for the page printed at 206 may be stored in the computer readable medium 128 by the controller 122. The separation location history is a count of the number of times a color separation is located at a location on the photo drum, e.g. the PIP 104.

In some examples, when printing a black and white image, the separation location history may comprise a count of the number of time the black color separation was located on each location (e.g. number of times on side A and number of times on side B, or number of times on respective quadrants A, B, C, and D) of the photo drum.

In some examples, the separation location history may also contain a total number of separations printed. The total number of separations printed is the sum of the count of the number of time the black color separation was located on one location (e.g. side A) plus the count of the number of time the black color separation was located on another location (e.g. side B), and any additional locations (e.g. if the locations comprise quadrants).

In some examples, the separation location history may comprise a count of the number of times a color separation was located on a specific location (e.g. side or quadrant) of the photo drum, and a total number of times the color separation has been located on the photo drum.

In some examples, when printing a color image, the separation location history may comprise a count for the number of times each color separation is printed onto each location (e.g. side or quadrant) of the photo drum. For example, in a 4 color process (e.g. CMYK), each of the four color separations would have a count for the number of times that separation was located on each location (e.g. sides A and B, or quadrants A, B, C, and D).

For a given color separation order on the photo drum, the position of one of the color separations on the photo drum may determine the positions of the other color separations on the photo drum. Therefore, in another example, the separation location history may comprise a count for the number of times the color separation for a single color is printed onto each location (e.g. side or quadrant) of the photo drum. For example in a 4 color process (e.g. CMYK), the separation location history may be a count for the number of times the cyan color separation is printed onto each location (e.g. side or quadrant) of the photo drum.

As discussed earlier, in examples, the color separations may be created on a photo drum at the same or different locations as in the previous color separation cycle.

At 210, the print history count may be compared to a print history count threshold N by the controller 122. How often the separation location history is checked to determine if the location separations are balanced may be based on whether the count threshold N is exceeded. The count threshold N may be any value, for example an integer between 1 and 1,500 pages (e.g. 100 pages), or between 4 and 6,000 color separations (e.g. 400 color separations).

The count threshold N may be set to different values depending on the type of print session being processed. In some examples, if the controller 122 predicts a high degree of ghosting in the current print session, then the controller 122 may set a lower count threshold N. In some examples, if the controller 122 predicts a low degree of ghosting in the current print session, then the controller 122 may set a higher count threshold N. In some examples, the count threshold N may be set to a lower value when printing fully saturated images and may be set to a higher value when printing less saturated images. In some examples, the count threshold N may depend on information regarding the graphic elements within the image to be printed, color coverage in the image, substrate size (e.g. width and/or length), the age of the blanket, the age of the photo drum, or combinations thereof. In some examples, the count threshold N may be set to a different value for each print job. In some examples, the count threshold N may depend on other factors. If the print history count is above the count threshold N, the method 200 may proceed to 212, otherwise the method 200 may proceed to 218.

At 212, the print history count value may be reset by the controller 122. In some examples, the print history count value may be set to a non-zero value (e.g. a negative value), for example if the printing session includes a calibration print job such as printing an automatic cleaner page (e.g. to clean to printing module 100). This may be done to offset any increments to the print history count value resulting from the calibration print job. In some examples, rather than using a non-zero print history count value, to achieve an equivalent effect the count threshold N used at 210 may instead have had a higher value when the printing session includes a calibration print job relative to if the printing session does not include a calibration print job.

In some examples, whether the print history count is reset to zero or nonzero, and the particular value that the print history count is reset to, may e.g. depend on the degree to which the current print session (e.g. print job) is currently exhibiting or predicted by the controller 122 to exhibit ghosting. For example, the controller 122 may reset the print history count to a higher value if the controller 122 determines that the current print sessions is exhibiting a high degree of ghosting or predicts a greater degree of ghosting, and a lower value (e.g. e.g. a low positive value, zero, or a negative value) if a low degree of ghosting is currently being exhibited or is predicted to occur.

At 214, the separation location history may be checked by the controller 122 to determine if it is within a threshold range. In some examples, the separation location history threshold range is centered at 50%, and may span a value between 10% and 50% (e.g. the threshold range may be between 45% to 55%, or 25% to 75%, or any threshold range in between those ranges). In some examples, the threshold range is between 40% and 60%. This means that when a specific color separation has been printed on one location by more than 60% of the time or has been printed on one location by less than 40% of the time, the separation location history would be beyond the separation location history threshold range.

In some examples, when printing black and white images, the separation location history may be checked to determine the balance between the number of times a black separation has been printed on a first location relative to the number of times the black separation has been printed on a second location.

In some examples, when printing images with multiple separations (e.g. CMYK), the separation location history may be checked to determine the balance between the number of times a selected one of the color separations (e.g.

black, or any one of the other color separations) has been printed on a first location relative to the number of times the same selected one of the color separations has been printed on a second location. In some examples, the presumed sufficiency of checking the balance of the separation location history of one color separation rather than multiple or all four color separations may be based on the assumption that the balance of the separation location history of any single color separation may be representative of the balance of the other color separations as well. Additionally, checking one rather than multiple color separations may reduce computing complexity.

In other examples, when printing images with multiple separations (e.g. CMYK), the separation location history for each of the color separations may be checked to determine their respective balances. In some of these examples, the determination of whether the separation location history is within a threshold range may be based on (1) checking whether the average of the balances of each of the color separation histories for the different color separations (e.g. 40% for C, 45% for M, 50% for Y, and 55% for K may result in an average separation location history balance of 47.5%) is outside a threshold range; or (2) checking whether the color separation history having the maximum imbalance (e.g. furthest from 50%) is outside the threshold range (e.g. in the above example, 40% for C would be the maximum imbalance). Other methods may also be used.

Because the separation location history may track the number of times a color separation is printed in a given location on the photo drum, location changes of the color separation caused by delays in the printing system 100 may be compensated for using method 200. For example, when a delay in a component of the printing system 100 causes an odd number of null segments to be inserted into the image pipeline, the location of the color separations may change positions on the photo drum. This change in positions may be tracked and the next time the print history count exceeds the count threshold N, the separation location history may be within the separation location history threshold range and no null segments will need to be added the image pipeline. In some examples, any number of odd null cycles may be randomly added to the image pipeline due to at least one print component not being ready. In some examples, occurrence of a delay in the printing system may also cause the controller 122 to reset the print history count to zero. The decision as to whether to reset the print history count to zero may depend on the print history count relative to the count threshold N, or may depend on the separation location history and/or the separation location history threshold, etc.

In some examples, the separation location history threshold range may be adjusted for each print session. By adjusting the count threshold N and the separation location history threshold range, a trade-off between separation balance and utilization may be made. For example, when the count threshold N is set to 1 and the separation location history threshold range is set to 50% the color separations would change locations on the photo drum after each page was printed. Because the locations of the color separations are changed by inserting a null segment into the print pipeline, this would slow the printing process by half of a drum revolution for each page.

By adjusting the count threshold N and the separation location history threshold range for different page types, the appropriate balance between utilization and separation location history balance may be made. When the separation location history is within the threshold range at block 214, the method 200 may proceed to 218, otherwise the method 200 may proceed to 216.

At 216, the positions of the color separations on the photo drum may be changed by the controller 112. In some examples, the positions of the color separations may be changed by inserting an odd number (e.g. 1 or 3, or a larger odd number) of null segments into the image pipeline. In some examples, 1 null segment may be inserted in each iteration of 216, in other examples another number of null segments may be inserted in each iteration of 216, and in other examples different odd numbers of null segments may be inserted in different iterations of 216. In other examples, the controller 122 may change the location of the color separations from one side of the photo drum to the other side of the photo drum, e.g. by switching locations of two color separations or by switching locations of more than two color separations.

At 218, a check may be made by the controller 122 to see if the printing session has been completed. If the print session is not done, the method may proceed to 206, otherwise the method 200 may proceed to 220, at which point the print session may be ended. In some examples, the separation location history may be saved at the end of each print session for later use.

At 222, a new print session may be started using the printing system 100. The new print session may be initiated immediately after the completed print session, or after a time period in which the printer has not being used for printing.

At 224, the controller 112 may determine whether to reset the separation location history and the print history count.

In some examples, the determination may depend on the current balance of the separation location history, e.g. whether the separation location history is outside a threshold range. In examples, if the separation location history is outside a threshold range (in one examples above 55% or below 45%, and in another example above 65% or below 35%) then it may be determined that the separation location history and the print count history are to be reset. Thus, if the separation location history is inside the threshold range, then it may be determined that the separation location history and the print count history are not to be reset.

In some examples, the determination may also depend on the value of the print history count relative to the count threshold N. For example, if the print history count is above a threshold percentage (e.g. 50%) of the count threshold N, then it may be determined that the separation location history and the print count history are to be reset, and if the print history count is below the threshold percentage, it may be determined that the separation location history and the print count history are not to be reset.

In some examples, it may be determined that the separation location history and the print count history are to be reset if both (1) the separation location history is outside a threshold range; and (2) the print history count is above a threshold percentage of the count threshold N; and otherwise they are not to be reset. In other examples, if one of these conditions is satisfied then it may be determined that the separation location history and the print count history are to be reset, and if neither is satisfied then it may be determined that the separation location history and the print count history are not to be reset.

If it is determined that the separation location history and the print count history are to be reset, then the method 200 may proceed to 204, otherwise the method 200 may proceed to 206.

All of the features disclosed in this specification (including any accompanying claims, abstract and drawings), and/or all of the elements of any method or process so disclosed, may be combined in any combination, except combinations where at least some of such features and/or elements are mutually exclusive.

In the foregoing description, numerous details are set forth to provide an understanding of the subject matter disclosed herein. However, examples may be practiced without some or all of these details. Other examples may include modifications and variations from the details discussed above. It is intended that the appended claims cover such modifications and variations.

The invention claimed is:

1. A printing system, comprising:

a photo drum having a first location and a second location at which to repeatedly receive a color separation; and a controller to change a location at which the photo drum will next receive a first color separation on the photo drum from the first location to the second location when a separation location history for the first color separation is outside of a threshold range.

2. The printing system of claim 1, wherein the separation location history is outside the threshold range when the first color separation has been positioned in the first location more than a first percentage of a total number of times that the first color separation has been positioned on the photo drum or when the first color separation has been positioned in the first location less than a second percentage of the total number of times that the first color separation has been positioned on the photo drum.

3. The printing system of claim 2, wherein the first percentage is between 55% and 75%, wherein the second percentage is between 25% and 45%.

4. The printing system of claim 1, wherein the controller is to change the location of the first color separation on the photo drum from the first location to the second location by inserting an odd number of null segments into a print image pipeline.

5. The printing system of claim 1, wherein the controller is to change the location of the first color separation on the photo drum from the first location to the second location by switching locations of the first color separation and a second color separation.

6. The printing system of claim 1, wherein the controller is to test the separation location history against the threshold range every N number of pages or separations printed.

7. The printing system of claim 6, wherein N is an integer value between 1 and 1500 pages printed or an integer value between 4 and 6000 separations printed.

8. The printing system of claim 1, wherein the first location is one side (side A) of the photo drum and the second location is a second, different side of the photo drum (side B).

9. The printing system of claim 1, wherein the controller is to reset the separation location history after changing the location for the first color separation.

10. The printing system of claim 1, wherein during each revolution of the photo drum, the photo drum is to receive the color separation at either the first location or the second location.

11. The printing system of claim 1, wherein the controller is to reset the separation location history after finishing a print session.

12. The printing system of claim 1, wherein the controller is to reset a print history count of the separation location history to a value based on a prediction of a degree of ghosting.

13. The printing system of claim 12, wherein the controller predicts the degree of ghosting based on saturation of an image being printed.

14. The printing system of claim 12, wherein the controller predicts the degree of ghosting based on any of graphic elements within an image to be printed, color coverage in the image, substrate size, an age of a transfer blanket, and an age of the photo drum.

15. The printing system of claim 1, wherein the controller is to count only time the first color separation is applied to the photo drum and to determine from this positions and counts of other color separations.

16. A method of printing, comprising:

writing a first plurality of copies of a first separation image onto a first location on a photo drum and a second plurality of copies of the first separation image onto a second location on the photo drum;

tracking, by a processor, a number of times the first separation image is written onto the first and second locations;

balancing the number of the first plurality of copies of the first separation image written on the first location with the number of the second plurality of copies of the first separation image written on the second location.

17. The method of claim 16, wherein the copies are balanced when the number of copies written on the first location is less than a first percentage of a total number of copies written onto the photo drum and the number of copies written on the first location is greater than a second percentage of the total number of copies written onto the photo drum.

18. The method of claim 16, further comprising:

writing a first plurality of copies of a second separation image onto the first location and a second plurality of copies of the second separation image onto a second location;

tracking, by the processor, a number of times the second separation image is written onto the first and second locations;

balancing the number of the first plurality of copies of the second separation image written on the first location with the number of the second plurality of copies of the second separation image written on the second location.

19. A non-transitory computer readable storage medium including executable instructions that, when executed by a processor, cause the processor to:

cause a photo drum to repeatedly receive a color separation at one of a plurality of locations on the photo drum;

obtain a separation location history of each color separation, the separation location history comprising a count of the number of times a particular color separation was received on each of the plurality of locations on the photo drum; and based on the separation location history, balance the number of times the particular color separation is received on the first and second locations.

20. The non-transitory computer readable medium of claim 19, wherein the number of times is balanced by causing a print image pipeline to receive an odd number of null segments when the separation location history is outside of a threshold range.

* * * * *